US007596817B2

(12) United States Patent
Krapiva

(10) Patent No.: US 7,596,817 B2
(45) Date of Patent: Oct. 6, 2009

(54) PROTECTIVE HELMET

(75) Inventor: Pavel Krapiva, 7406 Meadow La., Chevy Chase, MD (US) 20815

(73) Assignee: Pavel Krapiva, Chevy Chase, MD (US)

( * ) Notice: Subject to any disclaimer, the term of this patent is extended or adjusted under 35 U.S.C. 154(b) by 312 days.

(21) Appl. No.: 11/208,179

(22) Filed: Aug. 22, 2005

(65) Prior Publication Data

US 2007/0050893 A1 Mar. 8, 2007

(51) Int. Cl.
*A42B 3/00* (2006.01)

(52) U.S. Cl. ..... 2/411

(58) Field of Classification Search ..... 2/410–415, 2/422, 425, 455, 468, DIG. 3, DIG. 10, 209.13, 2/2.5, 2, 202, 204, 206, 207
See application file for complete search history.

(56) References Cited

U.S. PATENT DOCUMENTS

| | | | | | |
|---|---|---|---|---|---|
| 1,284,240 | A * | 11/1918 | Close | ..... | 2/6.1 |
| 1,757,019 | A * | 5/1930 | Mott | ..... | 2/461 |
| 3,855,631 | A * | 12/1974 | Ettinger | ..... | 2/468 |
| 3,991,423 | A * | 11/1976 | Jones | ..... | 2/415 |
| 4,094,015 | A * | 6/1978 | Howard | ..... | 2/415 |
| 4,274,161 | A * | 6/1981 | Littler | ..... | 2/413 |
| 5,133,084 | A * | 7/1992 | Martin | ..... | 2/468 |
| 5,781,936 | A * | 7/1998 | Alaloof | ..... | 2/456 |
| 6,854,134 | B2 * | 2/2005 | Cleveland | ..... | 2/422 |
| 6,862,749 | B1 * | 3/2005 | Krause | ..... | 2/422 |

* cited by examiner

*Primary Examiner*—Katherine Moran

(57) ABSTRACT

A protective helmet has a main helmet part configured to cover a significant part of a user's head to protect the user's head in the case of accidents; and an additional inflatable element attached to the main helmet body and inflatable in the event of an accident so as to protect a neck of the user.

12 Claims, 1 Drawing Sheet

PROTECTIVE HELMET

BACKGROUND OF THE INVENTION

The present invention relates generally to protective helmets.

Protective helmets are used for protecting user's heads in the event of accidents, for example accidents of riders of motorcycles, bicycles, etc., as well as accidents occurring in other situations.

While the existing protective helmets protect user's heads from traumas, protection of user's neck rendered by them is unsatisfactory. In the event of an accidents many people obtain severe neck injuries, which in some cases result in partial or complete paralysis, etc. It is therefore believed to be clear that the existing protecting helmets can be further improved.

SUMMARY OF THE INVENTION

Accordingly, it is an object of the present invention to provide a protective helmet which is a further improvement of the existing protective helmets.

In keeping with these objects and with others which will become apparent hereinafter, one feature of the present invention resides, briefly stated, a protective helmet, comprising a main helmet part configured to cover a significant part of a user's head to protect a user's head in the case of accidents; and an additional inflatable element attached to said main helmet body and inflatable in the event of an accident so as to protect a neck of the user.

When the protective helmet is designed in accordance with the present invention, not only it protects the user's head, but also protects a user's neck from injuries, which he otherwise can incur in the case of accidents.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
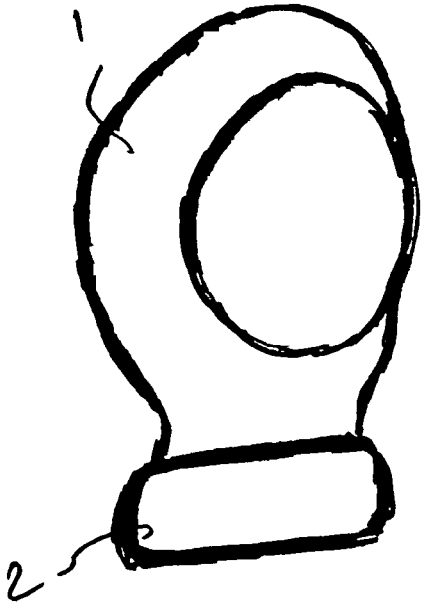
FIG. 1 is a view showing a protective helmet in accordance with one embodiment of the present invention, which is closed in a circumferential direction.

A protective helmet in accordance with he present invention shown in FIG. 1 has a main helmet part which is identified with reference numeral 1, and an inflatable element which is identified with reference numeral 2. The main helmet part 1, as well known in the art, can be formed as a circumferentially closed part, provided with an opening for a face of the user, so that the helmet can be fitted over the user's head in a use position.

The inflatable element 2 is arranged in the region of a lower edge of the main helmet part 1. In particular, it can be attached to the lower edge of the main helmet part 1.

Figure 2:
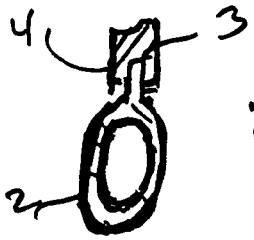
FIG. 2 is a view showing the cross-section of an area of the protective helmet between an additional inflatable element and a main helmet part.

One variant of such an attachment is shown in FIG. 2. The inflatable element 2 can be provided with an upwardly extending projection 3 which is received in a groove 4 in the lower edge of the main helmet part 1, and, for example, glued in the groove to its surfaces. It is to be understood that other means of connecting the inflatable element 2 to the lower edge of the main helmet part 1 are possible as well.

The inflatable element 2 can be formed in the shape of a hose having an inner hollow interior, which can be filled with a medium for its expansion in the event of the accident, for example with compressed air, etc.

Figure 3:
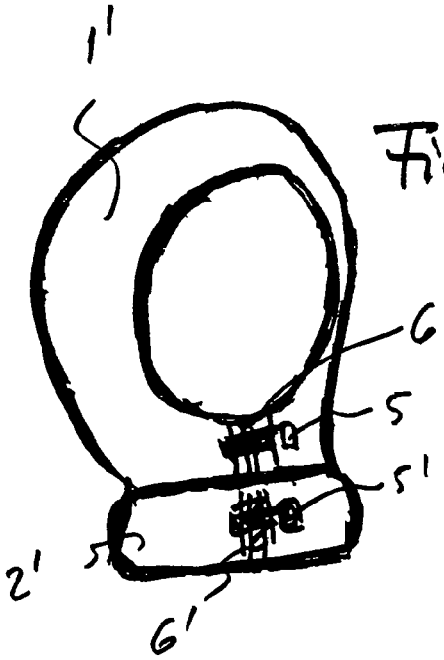
FIG. 3 is a view substantially corresponding to the view of FIG. 1 but showing an embodiment of the protective helmet in accordance with the present invention.

The protective helmet shown in FIG. 3 has a main helmet part 1' and an inflatable element 2' which is arranged in the region of the lower edge of the main helmet part 1'. The main helmet part 1' in this embodiment is not circumferentially closed but instead is open in its lower region. In order to close the helmet after it is fitted on a user's head, closing means are provided, and formed for example as means including a buckle 5 located on a portion of the main helmet part 1' at one side of a separation line, and a belt 6 located on the other portion of the main helmet part 1' at the opposite side of the separation line. The belt 6 can cooperate with the buckle 5 so as to close the main helmet part 1.

It is also possible that the inflatable element 2' is also not closed circumferentially as well. For its closing additional closing means can be provided, including a buckle 5' and a belt 6' cooperating with one another in the same manner as the buckle 5 and the belt 6 of the main helmet part 1".

In order to protect the user's neck from injuries in the event of an accident, the inflatable element 2, 2' inflates and forms a tire-shaped protective structure around the neck.

Figure 4:
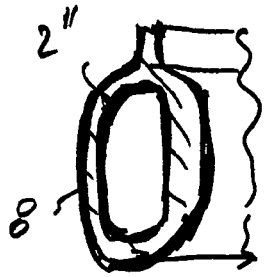
FIGS. 4 and 5 are views showing a cross-section of the inflatable element with two variants, for allowing a predominant outside expansion of the inflatable element and preventing an inside expansion of the inflatable element toward the user's neck.

In accordance with another embodiment of the present invention, the inflatable element is formed so that it expands radially outwardly away from the user's neck, and does not expand or expands only very little in the direction toward the user's neck so as to prevent squeezing of the user's neck. For this purpose as shown in FIG. 4, a radially inner wall 7 of the inflatable element 2" which faces towards the user's neck can be made thicker than a radially outer wall 8 of the inflatable element. As a result, when an inflating medium is introduced into the interior of the inflatable element, the radially outer wall expands outwardly, while the radially inner wall 7 does not expand inwardly so as not to affect the user's neck.

Figure 5:
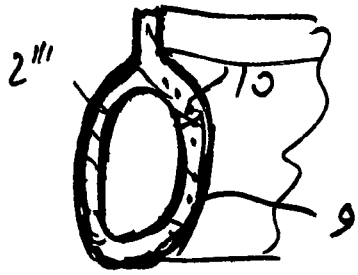
Figure 6:
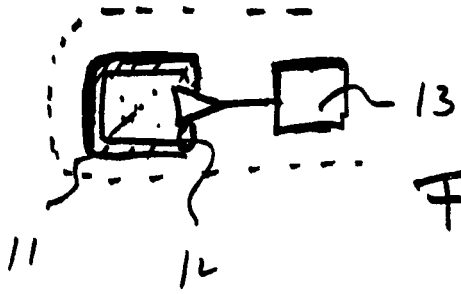
FIG. 6 is a view schematically showing a unit for releasing an inflating medium into the inflatable element in the event of an accident.

In accordance with another embodiment shown in FIG. 5, a radially outer wall 9 of the inflatable element 2'" can be provided with reinforcing elements 10, formed for example as multiple reinforcing rigid members, a single reinforcing plate, etc. In this case, the radially inner wall 9 also does not expand toward the user's neck or expands only insignificantly to prevent injuries to the user's neck.

In order to provide inflation of the inflatable element, the inventive helmet can be provided with a container 11 which accommodates an inflating medium, for example a compressed air. The container 11 can have a valve 12 which closes the interior of the container during the normal use of the protective helmet. A sensor 13 can be further provided and formed for example as an acceleration sensor, inertia sensor, etc., which reacts to an occurrence of an accident. In the event of the occurrence of an accident, the sensor 13 acts on the valve 12 (mechanically, electrically, pneumatically or in other possible way) so as to open the valve 12 and to momentarily release the medium, such as compressed air, from the interior of the container 11 into the interior of the inflatable element 2, thus inflating the inflatable element with a high speed, to immediately react to the occurrence of accident and to protect not only the head of the user, but also his neck from injuries.

It will be understood that each of the elements described above, or two or more together, may also find a useful application in other types of constructions differing from the types described above.

While the invention has been illustrated and described as embodied in a protective helmet, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A protective helmet, comprising a main helmet part configured to cover a significant part of a user's head to protect the user's head in the case of accidents; and an additional inflatable element attached to said main helmet body and inflatable in the event of an accident so as to protect a neck of the user; and means for predominantly allowing expansion of said inflatable element in a direction away from the user's neck and preventing expansion of said inflatable element in a direction toward the user's neck, wherein said allowing and preventing means include a radially outer wall of said inflatable element which said radially outer wall is easier to expand, and a radially inner wall of said inflatable element which radially inner wall of said inflatable element is harder to expand, wherein said radially inner wall is thicker than said radially outer wall.

2. A protective helmet as defined in claim 1, wherein said helmet part has a lower edge, said inflatable element being located in a region of said lower edge of said main helmet part.

3. A protective helmet as defined in claim 1, wherein said main helmet part has a lower edge, said inflatable element being attached to said lower edge of said main element part; and further comprising means for attaching said inflatable element to said lower edge of said main helmet part.

4. A protective helmet as defined in claim 1, wherein said main helmet part is closed in a circumferential direction, said inflatable element being also closed in the circumferential direction.

5. A protective helmet as defined in claim 1, wherein said main helmet part is not closed in a circumferential direction; and further comprising means for closing said main helmet part in the circumferential direction.

6. A protective helmet as defined in claim 5, wherein said closing means include belt and buckle means.

7. A protective helmet as defined in claim 5, wherein said inflatable element is also not closed in a circumferential direction; and further comprising additional closing means for closing said inflatable element in the circumferential direction.

8. A protective helmet as defined in claim 7, wherein said additional closing means include belt and buckle means.

9. A protective helmet as defined in claim 1, wherein said radially inner wall is provided with a rigidifying means.

10. A protective helmet as defined in claim 1; and further comprising sensing means for sensing an occurrence of the accident and causing inflation of said inflatable element.

11. A protective helmet as defined in claim 10; and further comprising means for storing a compressed medium and releasing the compressed medium into said inflatable element in the event of the accident.

12. A protective helmet as defined in claim 11; and further comprising sensing means for sensing an occurrence of the accident and acting on said storing and releasing means so as to release the compressed medium upon sensing of the occurrence of the accident into said inflatable element.

* * * * *